United States Patent [19]

Kuby

[11] 4,028,991

[45] June 14, 1977

[54] WEAPON SYSTEM

[75] Inventor: Milton Kuby, Huntington Station, N.Y.

[73] Assignee: Fairchild Industries Inc., Germantown, Md.

[22] Filed: Oct. 10, 1975

[21] Appl. No.: 621,499

[52] U.S. Cl. ..... 89/41 ME; 89/41 L; 356/152

[51] Int. Cl.[2] ..... F41G 3/02

[58] Field of Search ..... 89/1.5 E, 41 E, 41 EA, 89/41 ME, 41 L, 41 TV, 41 SW, 41 S; 244/3.16; 250/203 R; 356/29, 152; 102/70.2 P

[56] References Cited

UNITED STATES PATENTS

| | | | |
|---|---|---|---|
| 2,399,426 | 4/1946 | Bradley | 89/41 SW |
| 2,656,532 | 10/1953 | Crump | 89/41 SW |
| 3,837,283 | 9/1974 | McCracken | 102/70.2 P |

OTHER PUBLICATIONS

Merrill I. Skolnik, Radar Handbook, *Laser Radars*, "Applications", McGraw-Hill Book Co., 1970, pp. 37–60.

*Primary Examiner*—Stephen C. Bentley
*Attorney, Agent, or Firm*—Michael W. York

[57] ABSTRACT

A weapon system adapted to accurately fire projectiles in rapid succession which includes a weapon sighting, target designating and locating means that is operatively connected so that the weapon might be selectively fired when a visual image and an image derived from a reflected beam from a beam illuminated target, are superimposed within the weapon operator's sighting device. A remotely located beam generator is utilized to illuminate an intended target with a pulsed frequency beam, such as a laser. A beam receiver tuned to the same pulsed frequency, is responsive to the reflected beam and utilizes it to determine the relative position of the weapon and the target and processes this information to produce signals based upon the relative position of the target and weapon. These signals are fed to a comparator which is also furnished with a signal that is representative of a visual line of sight through the weapon's sighting device and in cooperation with a servo mechanism facilitates the projection of a reticle for each signal upon a display in the weapon operator's sighting device.

Appropriate circuitry is provided for the weapon system which relies upon a balanced voltage that is represented on the display when a sight induced target reticle and beam induced target reticle are superimposed, to complete the previously armed firing circuit to the weapon to enable the weapon to be fired at the target. The firing of the weapon will continue until the firing circuit is interrupted when the reticles on the display divert and are no longer superimposed, or the weapon's trigger is released. Means are also provided in the circuit to enable the weapon to be trigger operated in a conventional manner, independently of the target illuminating and reflected beam.

4 Claims, 3 Drawing Figures

WEAPON SYSTEM

BACKGROUND OF THE INVENTION

Weapon systems have been undergoing development for a considerable period of time and in recent years, substantial improvements have been made which enable various types of weapons to be employed more effectively by reducing the human skills required in the various facets of their operation. As an example U.S. Pat. No. 3,548,212 discloses a device which utilizes a multi-beam laser to lock onto and track an intended target. In the arrangements shown in this patent, a reflected laser beam is utilized to operate a servo and bring a gun mounted in a vehicle into alignment with and then lock on to a moving target. Another device as disclosed in U.S. Pat. No. 3,457,827, relies upon the sensing of infra-red radiation emitted from an intended target to home a gun on the target and provide an indication to the gun operator of the optimum time for firing the gun.

However, with the advent of modern versions and derivatives of rapid fire automatic weapons generally referred to as "Gatling" guns considerations unique to the use of the type of weapon have been brought into sharper focus. Such modern day versions of these weapons are not only capable of firing projectiles of considerable size, but also have the capability of firing as much as four thousand rounds of such ammunition per minute through a multiplicity of rotating gun barrels. While it can be readily appreciated that such massive and concentrated firepower will have a devastating effect upon its targets, huge quantities of ammunition are expended. Thus the operation of weapons of this type is not only costly, but impose severe and difficult logistic burdens as well.

In addition, when such weapons are situated in combat vehicles such as tanks, aircraft, ships and boats, the weapon carrier must contain suitable provisions to accommodate the vast quantities of ammunition that such weapons can expend in order that they might be effectively used.

Moreover, when weapons of this type are mounted in certain of these vehicles and aircraft in particular, the weight of a sufficient quantity of ammunition to enable the use of the weapon in the most effective manner will often account for a substantial percentage of the aircraft's payload capability. Consequently, serious compromises will oftentimes be made with respect to making determinations as to the quantities of ammunition and fuel load or in the provision of additional weaponry or ordnance as might otherwise be carried aboard the aircraft to enhance its mission capabilities. Once committed to such pre-determined decisions as to weapon mix and fuel load, the aircraft's mission profile is well established. Consequently, the mission flexibility of the aircraft once in progress is substantially reduced and its ability to respond to changing circumstances or combat situations that assume a different complexion is somewhat hampered. As an example, if in making such judgments it is determined that the fuel portion of the payload is to be reduced to favor an increase in the amount of ammunition for a rapid fire gun of the type mentioned above, or other ordnance is to be carried on a given mission, the aircraft's operating range or loiter time over suspected targets will understandably be reduced. In view of this, improving the effectiveness of the weapon systems by improving its accuracy is absolutely essential in that it will result in a smaller quantity of ammunition which will be required during a mission to achieve the desired results.

In the case of rapid fire weapons of the type mentioned above and referred to as the Gatling gun, improved accuracy in the use of the weapon would be reflected in the quantity of ammunition that had to be expended in order to neutralize a target. However, despite improvements which might be made in the accuracy of these weapons, the manner in which they are ordinarily used is a major factor in their consumption of ammunition. In this connection, it is customary when firing such weapons to spray the target area with gun fire. In the case of a rapid fire guns mounted in a vehicle such as an aircraft, and particularly in those aircraft equipped with fixed forward pointing guns that require that the aircraft be pointed at the intended target, the fire from guns is ordinarily "walked" across the target area to assure that a number of rounds will in fact strike the target. In practice this means that a considerable quantity of ammunition must be expended of which only a small percentage will at best, actually strike the target. Understandably, as the rate of fire of each particular gun increases, so too does the amount of ammunition ineffectively consumed in this manner. This ineffective use of ammunition has been substantiated and graphically illustrated by film frames taken of typical low angle strafing runs of aircraft having fixed forward facing, rapid fire gatling type guns. Examination of such films and correlation with the action of the gun operator reveal that the gunsight pipper, which is known to those skilled in the art as the reference dot within a gunsight, was held on an estimated 50 square foot target for only 0.2 to 0.3 seconds per successful strafing run, or for about 30 percent of a 1 second firing burst. This time is of course not absolute, but a representative sample based upon such things as the function of aircraft controllability and stability and the simple reaction time for an average 25 year old combat trained aircraft pilot/gun operator squeezing the trigger when the target appears in the gun sight.

This procedure results in a considerable miss probability so it is not an uncommon practice to compensate for the reaction time and some of the other variables, as well as the abbreviated time during which the target appears in the gunsight reticle by firing early, that is, before the target appears in the reticle and continuing to fire so as to "walk into" the target. While this technique improves the hit probability without question, the quantity of ammunition which misses the target and is therefore "wasted" is tremendous.

To fully appreciate several other important aspects of these wasteful practices, the weight and cost of the ineffective ammunition must also be considered. In this connection and based upon the observations of the film frames mentioned above, the wasted portion of a 1 second gun fire burst of 30 millimeter ammunition can be translated to a weight of 1470 pounds and a cost of $14,200. These figures are based upon 1350 total rounds of ammunition × 70percent × 1.56 lb/per round at a cost estimated conservatively at $15 per round. As could be expected, as the gun fire burst time increases, so too does the amount of ammunition ineffectively consumed and along with it the attendant increase in its cost and weight of the larger percentages of wasted ammunition.

Perhaps even more importantly, when the aforementioned gunnery techniques are used under certain comat conditions, unintended, but substantial risks to iendly forces are often incurred. In this connection, apid fire weapons of the type being discussed are most ffective against positions, such as entrenchments, arıored vehicles and the like and are frequently used gainst them in support of friendly ground forces. Inder such conditions aircraft equipped with these uns often conduct strikes against these targets in suport of friendly ground forces located or moving in roximity to the intended target. As a consequence ıose ground forces are exposed to the real danger of eing fired upon unintentionally by the gun operator. nother major disadvantage arises from the fact that ftentimes in such combat circumstances the firing of ıe gun may be deliberately delayed as a precautionary ıeasure to minimize the danger to those ground forces, ssening even further the likelihood of striking the ıtended target and diminishing even further the effecveness of the gun fire. Moreover, with the heightened ossibilities that the target will not be neutralized on ıe first pass, due to the ineffectiveness of the gun fire, n additional pass or passes may be necessary to satisfy ıe mission requirements, increasing the risks that are oincident with repeated exposures to hostile action. bviously, such repeated passes no longer have the dvantages of surprise and are more likely to encounter ıarshalled countermeasures that have been alerted, ıbsequent to the initial strike of the attacking aircraft.

SUMMARY OF THE INVENTION

This invention relates to weapon systems and more articularly to an improved weapon system that is caable of operating in an efficient and effective manner.

It is accordingly an object of the present invention to rovide a system which permits the weapon to be fired ccurately at a preselected target, and reduce the haıd to friendly forces in proximity to the target.

It is another object of the invention to provide a rapid re weapon system which will permit a concentration f the fire produced by the weapon to be directed at a re-selected target.

It is also an object of this invention to reduce the mount of ammunition that is ordinarily expended by a ıpid fire weapon to destroy a pre-selected target.

It is an additional object of the invention to achieve reater economies in the cost of operation of a rapid re weapon by the reduction in the amount of ammunion that must be used by the weapon against a given ırget.

It is a still further object of the present invention to educe the weight of the weapon system by reducing ıe overall weight of the ammunition necessary to opate the weapon effectively.

It is also an underlying object of the present invention improve the performance of any vehicle with which ıe improved weapon system of the present invention is ssociated.

Another object of the invention is to reduce the exosure of any associated weapons carrier to hostile ction by maximizing the fire effectiveness of the imroved weapon system and thereby minimizing the me during which the weapon system and vehicle with hich it may be associated is vulnerable.

It is a still further object of the invention to reduce or liminate repeated passes at a given target and thereby ramatically improve the prospects of survivability of ıe weapon system and its associated vehicle in any iven combat situation.

The present invention provides an improved weapon system that is adapted to fire projectiles in rapid succession comprising firing means operatively connected to the weapon and sighting means operatively associated with the weapon for visual aiming of the weapon at a target. Means independent of the weapon are adapted to illuminate the target with a beam such as a laser and means connected to the sighting means and firing means are adapted to receive a reflected beam from the illuminated target and permit the weapon to fire when the reflected beam and target image are superimposed in said sighting means.

BRIEF DESCRIPTION OF THE DRAWINGS

The invention will be hereinafter more fully described with reference to the accompanying drawings in which.

DETAILED DESCRIPTION OF THE PREFERRED EMBODIMENT

Figure 1:
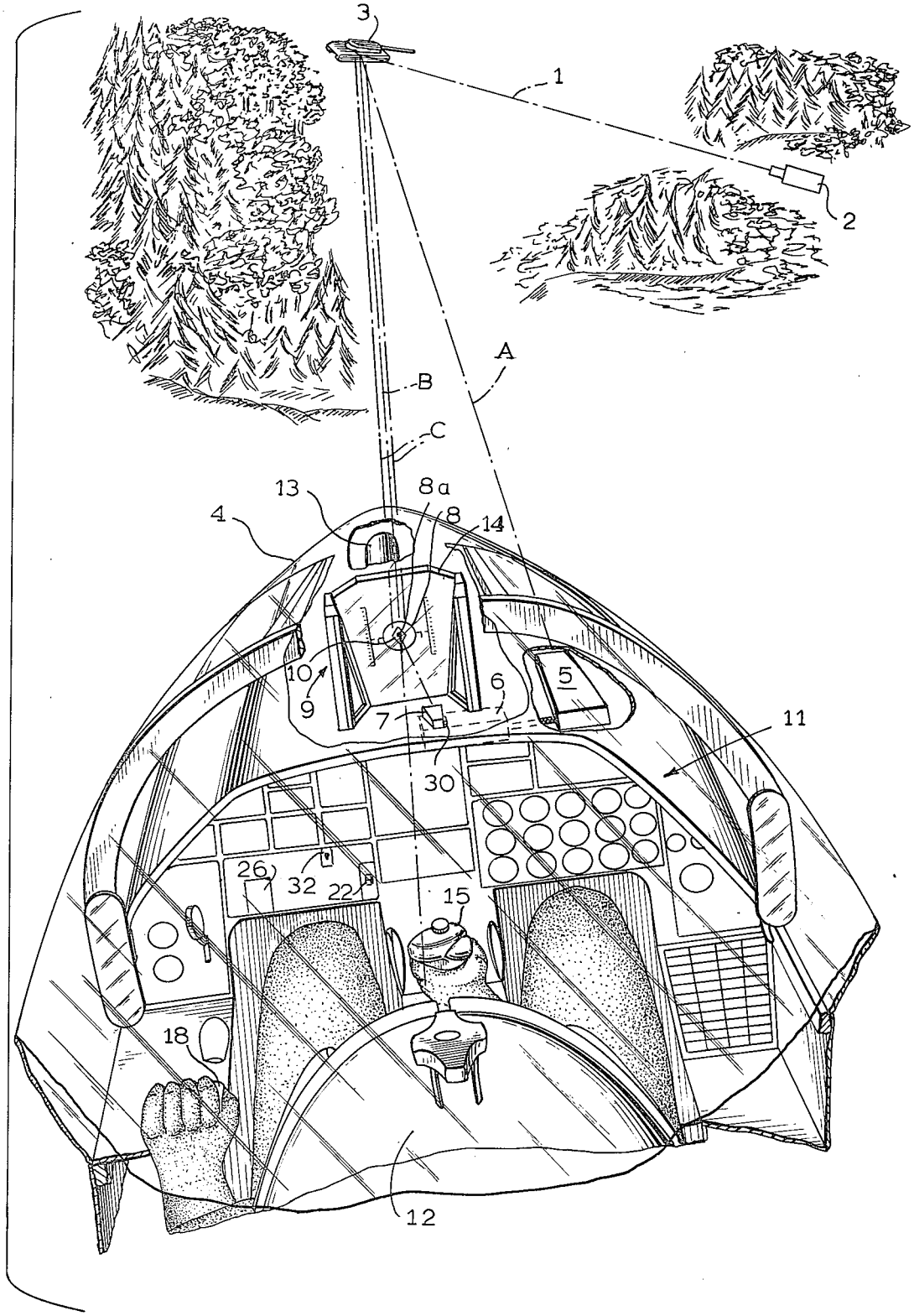
FIG. 1 is a pictorial representation from a near pilot's eye view of the cockpit and forward portion of an aircraft provided with elements of the improved weapon system of the present invention and showing the weapon system in use against an intended target.

If reference is made to FIG. 1 in the drawings, the weapon system of the present invention has been portrayed in a near pilot's eye view of a combat scenario that is typical of the intended use and operation of the improved weapon system. Although it is shown and described in its present embodiment as operatively associated with an aircraft, it should be understood and appreciated at the outset, that it is readily adaptable to other vehicles and weapon carriers such as ships and tanks and the like.

In the present arrangements, the invention incorporates the use of a target designating laser beam 1 that is generated at a pre-selected pulsed frequency, by a suitable lesser generator of the type generally known to those skilled in the art. The beam generator 2 is remotely located from the weapon and, in the present embodiment, adapted to be operated by a target selector or observer (not shown) customarily used in combat situations concerned with what is generally referred to as close air support missions. However, the beam generator may alternatively be carried and operated by a crew member aboard the weapon carrier or any other vehicle that may be provided for that purpose.

The intended target 3 which is represented in the drawings as a tank, is thereby illuminated by the pulsed frequency laser beam 1 which is reflected by the target in all directions and re-reflected from other objects in the vicinity as well. The cockpit and nose portion of an aircraft 4 is shown and indicated in FIG. 1, and in phantom lines in FIG. 2, in the drawings. A laser beam receiver 5 equipped with a gimballed seeker head (not shown) of a type known to those skilled in the art, is situated in the aircraft 4 and is tuned by the pilot to the prescribed frequency of the laser beam 1 being produced by the laser beam generator 2. Such beam receivers normally operate to seek out and lock on to the strongest return signal designated by the phantom line A in FIGS. 1 and 2, that is reflected from the laser illuminated target 3. The gimballed seeker head in such receivers are normally provided with pickoffs to furnish target acquisition and location information in the form of varying voltage outputs which are based upon the angular relationship of the seeker head to the reflected beam A from the target 3.

In the present arrangements the target position information is transmitted to a servo 6 which operates a reticle error comparator 7 that compares the voltages produced and processed in the beam receiver 5 with voltages generated within a conventional gun sighting mechanism (not shown) which is well known to those skilled in the art and which normally drive a reticle 8 that is displayed on a sighting device 9. The reticle 8 is also provided with the customary pipper 8*a* at its center.

Although signals from the servo 6 may be utilized to position reticles generated in a well-known fashion on a cathode ray tube (not shown) that is ordinarily part of modern conventional gun sighting mechanisms, the reticle error comparator 7 may also be adapted to project a laser reticle 10 that is generated within the comparator in response to the reflected beam and is also displayed on the sighting device 9. The generated laser reticle 10 is diamond shaped so that is will, for obvious reasons, appear differently in the sighting device than the gun sight reticle 8 which is shown as the ring or circle as seen in FIGS. 1 and 2.

The aforementioned aircraft 4 is equipped with a cockpit area 11 that is adapted to carry one or more crew members to operate the aircraft and the gun, guns or weapons carried by the aircraft. In the particular example shown in the drawings, the aircraft pilot 12 also operates the weapon system as is customary in a substantial number of modern fighter or attack aircraft. The weapon which might be any of a number of rapid fire types many of which are generally referred to as Gatling guns is fixed in the nose of the aircraft 4. In such installations the fixed forward firing weapon which will hereinafter be referred to as gun 13 is aimed by directing the aircraft 4 at the intended target 3.

The previously mentioned sighting device 9 incorporates a transparent combining glass 14 which forms a part of what is commonly referred to as a "head up display" that is customarily used in such combat aircraft to furnish the required information to enable the pilot to concentrate his attention on the combat situation and operation of the aircraft without the necessity of having to divert his attention to the cockpit interior during critical combat maneuvers.

Figure 2:
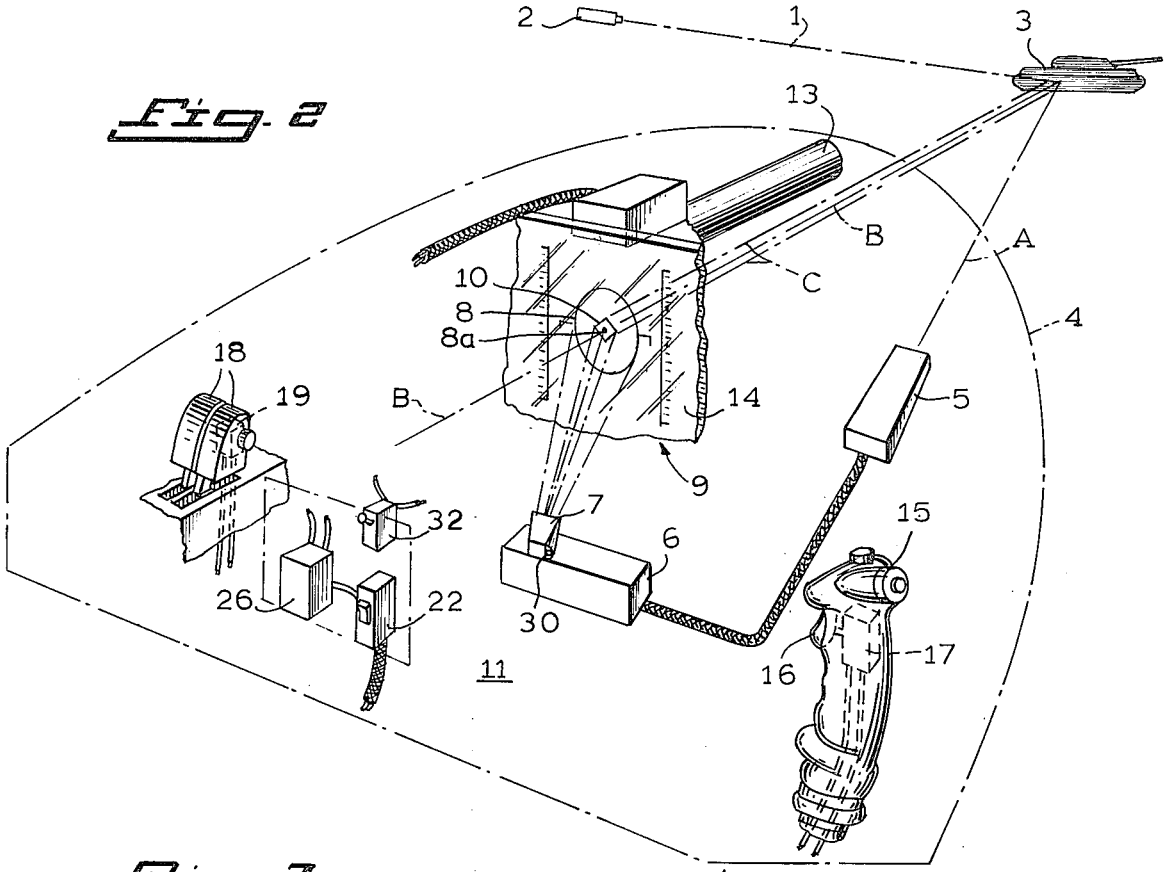
Fig. 2 is a perspective schematic view of the present invention showing the components of the improved weapons system illustrated in FIG. 1 and the interface of some of those components with the certain aircraft control members.

As best seen in FIGS. 1 and 2, the upper portion of an aircraft control stick 15 is situated in the cockpit 11 and utilized by the pilot 12 to direct and control the aircraft 4. In most combat aircraft of this type, the control stick offers a convenient and accessible location for a trigger 16 which is operated by the pilot to fire one or more forward facing guns or weapons carried by the particular aircraft. However, since in most instances, in modern day aircraft, because of the remote location of these weapons from the trigger, the trigger 16 usually operates to fire the gun or weapon through the intermediary of an electrical firing circuit so that as the trigger 16 is squeezed, a switch is closed and the gun firing mechanism (not shown) is energized to cause the gun to fire. The firing circuit of the improved weapon system of the present invention is schematically shown in FIG. 3 of the drawings, where a trigger actuated switch 17 has been shown in the normally open position and a more complete description of the firing circuit, its components and their functions will be forthcoming as we progress.

A throttle grip or grips 18 as in the case of multi-engined aircraft, are also situated in the cockpit 11 as best seen in FIGS. 1 and 2 and are used by the pilot to vary and adjust the aircraft's engine power settings in the customary fashion. Since the throttle grips 18 are readily accessible and often grasped by the pilot 12 under combat conditions in order to enable the pilot to maneuver the aircraft rapidly, they offer a convenient location for a laser designator switch 19 that is best seen in FIGS. 2 and 3 of the drawings. This switch is also part of the firing circuit and is essential to the operation of the improved weapons system of the present invention. The laser designator switch 19 is normally open as seen in FIG. 3, but when closed manually by the pilot, enables a laser designator coil 20 to which it is connected by a lead 21, to become energized.

Figure 3:
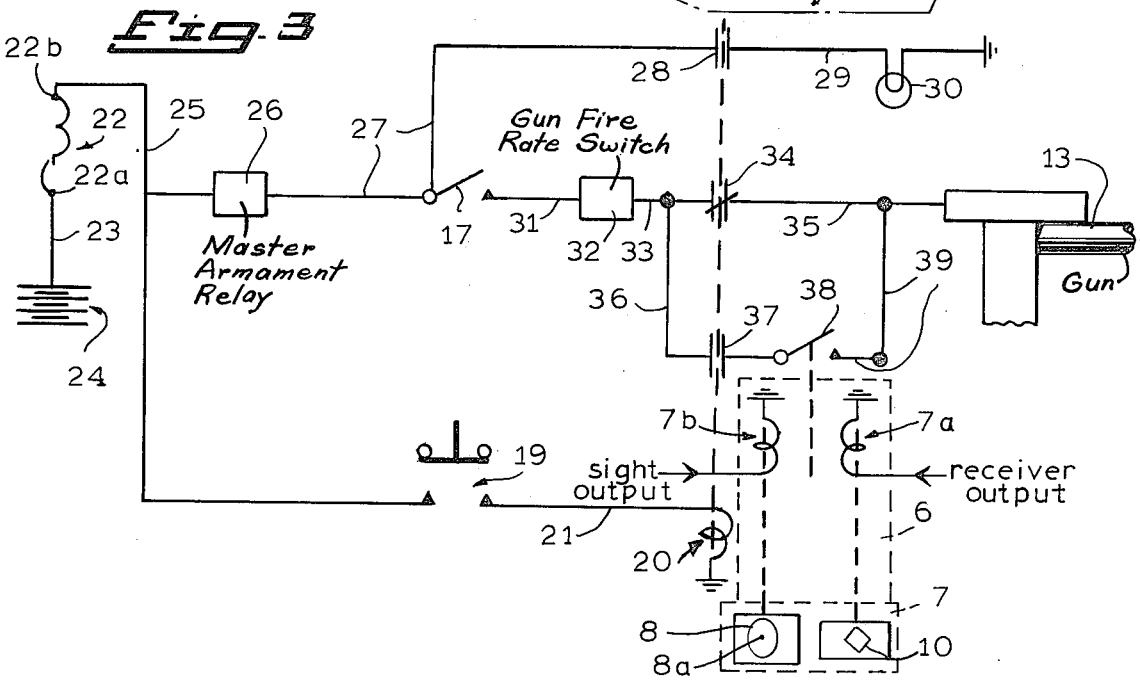
FIG. 3 is an electrical schematic of the present invention as illustrated in FIGS. 1 and 2.

A weapon system circuit breaker 22 which is of a conventional circuit breaker design is shown in FIGS. 1 and 2 and is illustrated schematically as well in FIG. 3. This circuit breaker is adapted to be manually operated by the pilot 12 or other personnel to energize the firing circuit while protecting the circuit in the usual manner against overloads which could develop in the circuit, in the event of a malfunction. One terminal of the circuit breaker 22, hereinafter referred to as the input terminal 22*a*, is connected by a lead 23 to a power source 24 which is provided to furnish electrical energy to the firing circuit. An output terminal 22*b* of the circuit breaker is connected by a lead 25 to a terminal of a master armament relay 26 and one pole of the aforementioned normally open laser designator switch 19 and serves to furnish electrical power when that switch is closed by the pilot, to the previously mentioned laser designator coil 20. Another lead 27 connects the armament relay 26 with a pole of the previously mentioned trigger switch 17 and a normally open relay contact 28, which in turn is connected by lead 29 to a laser designator mode indicator light 30, which is adapted to be energized when the normally open contacts 28, have been closed.

A lead 31 connects a pole of the normally open trigger switch 17 with a gun fire rate switch 32 of conventional design, which is selectively operated by the pilot 12. Switches of this type may operate in a variety of ways, such as by varying the output voltages or pulses within the switch mechanism to adjust the firing rate of such rapid firing weapons in accordance with the weapon operator's assessment of a given combat situation. In the weapon system of the present invention, the output from the gun rate switch is connected by lead 33 through a normally closed relay contact 34 and a lead 35 to the firing mechanism of the gun 13. In this manner electrical energy is furnished to the firing mechanism (not shown) of the gun, when the circuit breaker 22 has been actuated to energize the master armament relay 26 and the trigger switch 17 has been closed by the pilot's squeezing of the trigger 16, permitting electrical energy to pass through the normally closed relay contact 34 and its connecting lead 35 to fire the gun 13 until such time as the trigger switch is caused to open by relaxation of the pilot's pressure on the trigger.

A lead 36 is also connected to lead 33 and a normally open relay contact 37, the output of which is directed :o one pole of a normally open reticle error detection ;witch 38 which is adapted to be closed by a signal that s provided by the laser reticle comparator 7.

As indicated earlier, the reticle comparator 7 re-:eives the processed output signals from the laser beam :eceived which is used to energize a coil 7*a* while the ɔutput from the conventional sighting device 9 is used :o energize the coil 7*b* in the comparator 7. When the voltages are balanced in each coil, a signal will be gen-erated which will operate to cause the switch 38 to :lose, as shown schematically in FIG. 3. The output :erminal from switch 38 is connected by lead 39 to the ɔreviously mentioned lead 35 which connects the nor-nally closed relay contact 34 and the firing mechanism (not shown) of the gun 13. In addition, each of the aforementioned coils 7*a* and 7*b* in the comparator 7 nay be utilized to drive projection mechanisms of con-ventional design and well-known to those skilled in the art, to project the gun sight reticle 8 and the laser reti-cle 10 on the combining glass 14, as indicated schemat-cally in FIG. 3 of the drawing. However, as previously ndicated, other methods of producing and projecting the reticles on the combining glass may be preferable and more complementary to a particular gun sighting device.

As also indicated in FIG. 3 in the drawings, each of the aforementioned relay contacts 28, 34 (normally closed) and 37 are connected so that upon actuation of the laser designator switch 19 and energization of the coil 20, all of the relays will be effected so that the normally open relay contacts 28 and 37 will be closed and the normally closed relay contact 34 will be opened. Upon opening of the relay contact 34, electri-cal energy cannot be directed to the firing mechanism of the gun 13 even though the trigger switch 17 is held closed. However, when the reticle error comparator 7 generates a signal which causes the switch 38 to close, electrical energy will be transmitted through lead 39 of the gun firing mechanism of the gun 13.

To operate the improved weapon system of the pre-sent invention, the intended target 3 is illuminated by a predetermined pulsed frequency laser beam 1 pro-duced by a suitable laser generator 2 that may be oper-ated by a remote target selector or observer. The air-craft 4, equipped with the remaining portion of the improved weapon system is then directed toward the intended target by the pilot 12 who in the present ex-ample, also operates the weapon 13. The pilot then activates the aircraft's laser beam receiver 5 and tunes t to the particular predetermined pulsed frequency of the laser beam 1. As is well known in the art, the beam receiver 5 is receptive to the strongest reflected return signal that is received from a laser illuminated object and it locks onto that return signal A. As previously nentioned, most laser beam receivers are provided with gimballed pickoffs which are responsive to the angular relationship of the return signal A to the nounting vehicle for the receiver to produce azimuth, elevational and perhaps other relative position infor-nation such as pitch, roll and yaw parameters which are ultimately fed to the servo 6 and the reticle error comparator 7.

When the circuit breaker 22 is closed, power from he power source 24 is permitted to reach the master armament relay 26 and the laser designator switch 19 n the throttle grip 18. At this time the gun firing rate switch 32 is selectively operated by the pilot in accor-dance with his judgment and skills, to produce the desired gun firing rate which in his judgment would be most appropriate under the circumstances. As the pilot swings the aircraft 4 toward the target 3 he depresses the designator switch 19 thereby energizing the coil 20 which causes the connected relay contacts 28, 34 and 37 to be activated in the well-known fashion. Thus the normally open relay contacts 28 and 37 are closed and the normally closed relay contact 34 is opened, with the result that the electrical energy normally transmit-ted to the firing mechanism for the gun 13 when the trigger switch 17 is closed can no longer be conveyed by lead 35, but is shunted through lead 36, relay contact 37 and the reticle error detector switch 38. The closing of the reticle error detector switch 38 is, as mentioned above, based upon the comparison of the signal voltages in the coils 7*a* and 7*b* in the comparator 7 furnished by the beam receiver 5 and the signal from the normal sighting device 9, that is representative of the pilot/operators visual line of sight through the sight-ing device 9.

In addition, the closing of relay contact 28 permits electrical energy to be transmitted via the relay and lead 29 to the laser designator mode indicator light 30, to provide a prominent visual reminder of the laser operating mode to the pilot/weapon operator.

The pilot 12 continues to maneuver the aircraft 4 to visually align the target 3 on the combining glass 14 of the sighting device 9 and attempts to center the pipper 10*a* in the center of the laser reticle diamond that is projected on the sight with his line of sight B (which is represented in the comparator 7 by the sighting device output signal) on the combining glass as best seen in FIG. 1. The pilot squeezes the gun trigger arming the gun firing circuit and when the error between the gun sight line of sight B, and the laser reticle line of sight C becomes approximately zero, the reticle error detector switch 38 is closed by the balanced signal voltages in the comparator 7, to permit electrical energy to pass through lead 39 to the firing mechanism of the gun 13 so that the gun will fire in accordance with the pre-selected firing rate scheduled by the gun fire rate switch 32. The gun 13 will continue to fire as long as the pipper 8*a* and the laser line of sight C are held on the target. When the aircraft is maneuvered so that the target 3 is no longer aligned in this fashion the reticle error detector switch 38 will again be opened because of the voltage differential between the coils 7*a* and 7*b* in the comparator 7 breaking the circuit to lead 39 to cause the gun 13 to stop firing.

It should be noted that the pilot/gun operator 12 may at any time prior, or during these maneuvers, disengage the laser designator mode by releasing the switch 19 on the throttle grip to restore the gun operating circuit to conventional operation. In addition, it will be apprecia-ted that operation of the gun 13 can always be inter-rupted by release of the trigger 16 which causes the trigger switch 17 to open, thereby preventing electrical energy from reaching the firing mechanism of the gun 13.

It should also be understood that while the present arrangements have described with respect to the use of a laser beam other similar beams such as infrared, ra-dar, etc., might be used with appropriate minor modifi-cations that are will within the skills of those familiar with art. Although the invention has been described with reference to certain preferred embodiments, it will be understood that variations and modifications may be made within the spirit and scope of the invention as defined in the appended claims.

What is claimed is:

1. A weapon system adapted to fire projectiles in rapid succession comprising in combination, a weapon, means operatively connected and operable to fire the weapon, sight means operatively associated with the weapon to facilitate alignment of the weapon with a target and provide an indication thereof, said sight means including a transparent member, beam generating means operatively connected to the weapon system, and adapted to illuminate a target with the beam, receiving means operatively connected to the weapon system and receptive to a reflection of the beam from the illuminated target, said receiving means adapted to provide an indication of the relative position of the target with respect to the receiving means, comparator means adapted to receive said indications from said sight means and said receiving means and operate said weapon firing means, said sight means and said receiving means including means to compare said indications and locate and display target reticles on said transparent member in response thereto, the location of said target reticles displayed on said transparent member being responsive to the signals provided by said comparing means.

2. The weapon system of claim 1 wherein said firing means includes means to disconnect said firing means and said energy source coincident with a divergence of the target image and target reticles on said transparent member.

3. The weapon system of claim 2 wherein said firing means includes means to connect said energy source and said weapon independently of the signals provided by said comparing means.

4. The weapon system of claim 3 wherein said firing means includes means to vary the weapon fire rate.

* * * * *